US012611608B2

(12) United States Patent
Liu

(10) Patent No.: US 12,611,608 B2
(45) Date of Patent: Apr. 28, 2026

(54) TOY CAR

(71) Applicant: Wenrui Liu, Shantou (CN)

(72) Inventor: Wenrui Liu, Shantou (CN)

( * ) Notice: Subject to any disclaimer, the term of this patent is extended or adjusted under 35 U.S.C. 154(b) by 213 days.

(21) Appl. No.: 18/744,624

(22) Filed: Jun. 15, 2024

(65) Prior Publication Data

US 2025/0229190 A1 Jul. 17, 2025

(30) Foreign Application Priority Data

Jan. 16, 2024 (CN) ..... 202420107431.7

(51) Int. Cl.

| | |
|---|---|
| ***A63H 17/26*** | (2006.01) |
| ***A63H 17/36*** | (2006.01) |
| *A63H 29/22* | (2006.01) |
| *A63H 31/00* | (2006.01) |

(52) U.S. Cl.

CPC ..... *A63H 17/262* (2013.01); *A63H 17/36* (2013.01); *A63H 29/22* (2013.01); *A63H 31/00* (2013.01)

(58) Field of Classification Search

CPC ..... A63H 17/262; A63H 17/36; A63H 29/22; A63H 31/00

USPC ..... 446/469

See application file for complete search history.

(56) References Cited

U.S. PATENT DOCUMENTS 2,784,527 A * 3/1957 Sarff ..... A63H 17/36 273/109
4,159,126 A * 6/1979 Raleigh ..... B60G 11/00 446/466
4,533,336 A * 8/1985 Dixon ..... A63H 17/26 312/219
4,902,260 A * 2/1990 Im ..... A63H 31/00 446/164
7,128,634 B2 * 10/2006 Ogihara ..... A63H 30/04 446/469
11,701,597 B2 * 7/2023 Kwan ..... A63H 17/002 446/469
12,208,340 B1 * 1/2025 Chen ..... A63H 18/08
(Continued)

*Primary Examiner* — Kristina R Fulton
(74) *Attorney, Agent, or Firm* — Nitin Kaushik

(57) ABSTRACT

Disclosed in embodiments of the present application is a toy car, including: a chassis, where the chassis includes a first end portion, a middle body portion and a second end portion which are arranged in a first direction; two first wheels arranged at the first end portion and spaced apart in a second direction; two second wheels arranged at the second end portion and spaced apart in the second direction; and a first driving member and a second driving member which are both mounted at the middle body portion, where the second driving member and the first driving member are arranged in the first direction and/or the second direction, and the second driving member is configured to drive the two first wheels to turn. By means of the toy car provided in the embodiments of the present application, the situation that the mass and size of the first end portion are far greater than the mass and size of the second end portion can be reduced, thereby reducing the rollover probability of the toy car during traveling. In addition, the structure of the present application has the characteristic of high adaptability, and can be adapted to various low-height sports car simulation models with space limitations, thereby increasing the degree of simulation of the toy car, and improving the playability of the toy car.

13 Claims, 12 Drawing Sheets

(56) References Cited

U.S. PATENT DOCUMENTS

| | | | | |
|---|---|---|---|---|
| 2002/0123296 | A1* | 9/2002 | Tsang | A63H 17/36 446/444 |
| 2005/0079793 | A1* | 4/2005 | Ogihara | A63H 17/36 446/456 |
| 2011/0117815 | A1* | 5/2011 | Lee | A63H 31/00 446/448 |
| 2012/0276809 | A1* | 11/2012 | Verbera | A63H 17/36 446/465 |
| 2022/0347592 | A1* | 11/2022 | Qin | A63H 17/262 |

* cited by examiner

TOY CAR

TECHNICAL FIELD

The present application relates to the field of simulation remote-control model cars, in particular to a toy car.

BACKGROUND ART

A turning function of a toy car can be implemented by arranging a driving member for turning at a front wheel end or a rear wheel end of the toy car. The toy car, as a toy produced by simulating a car, can refer to the structure of an electric or hydraulic steering gear in the car, and the steering gear is reduced at the same proportion, thereby obtaining a second driving member. The mounting position of the driving member for turning in the toy car can refer to the mounting position of the steering gear in the car, that is, the driving member for turning may be mounted inside or above a suspension mechanism at the rear wheel end or the front wheel end.

With regard to existing remote-control toy cars, particularly small-proportion remote-control civilian sports car model car products, in view of the assembly requirements of components of the toy cars, the overall sizes of the toy cars are large. In other words, the structural compactness of the toy cars may be poor.

SUMMARY OF THE INVENTION

The present application aims to provide a toy car, so as to eliminate the above defects.

In order to solve the above technical problems, the purposes of the present application are achieved through the following technical solution:

embodiments of the present application provide a toy car, comprising: a chassis, where the chassis comprises a first end portion, a middle body portion and a second end portion which are arranged in a first direction; two first wheels, where the two first wheels are arranged at the first end portion and are spaced apart in a second direction, and the first direction is perpendicular to the second direction; two second wheels, where the two second wheels are arranged at the second end portion and are spaced apart in the second direction; a first driving member, where the first driving member is mounted at the middle body portion, and the first driving member is configured to drive the two first wheels and the two second wheels to rotate; and a second driving member, where the second driving member is mounted at the middle body portion, the second driving member and the first driving member are arranged in the first direction and/or the second direction, and the second driving member is configured to drive the two first wheels to turn.

Optionally, the toy car further comprises: an eccentric member, where the eccentric member is connected to the second driving member; and a steering frame, where the steering frame is movable connected to the first end portion, the steering frame is connected to the two first wheels, and the eccentric member is rotatably connected to the steering frame and is relatively movably connected to the steering frame; and the second driving member is configured to drive the eccentric member to rotate so as to drive the steering frame to move back and forth, thereby achieving turning of the two first wheels.

Optionally, the toy car further comprises: a first transmission assembly, wherein the first transmission assembly is arranged at the first end portion and is connected to the two first wheels, and the steering frame is rotatably connected to the first transmission assembly so as to be connected to the two first wheels; a second transmission assembly, wherein the second transmission assembly is rotatably connected to the second end portion and is connected to the first driving member and the two second wheels; and a transmission rod, wherein the transmission rod is connected to the first transmission assembly and the second transmission assembly; and the first driving member is configured to drive the second transmission assembly to move so as to drive the two second wheels and the transmission rod to rotate, and the transmission rod rotates to drive the first transmission assembly to move so as to drive the two first wheels to rotate.

Optionally, a first positioning platform protrudes from the first end portion in a third direction, the transmission rod is rotatably connected to the first positioning platform, and the third direction is perpendicular to the first direction and the second direction; and the steering frame comprises: an arch portion, wherein the arch portion is arranged around the first positioning platform, the first positioning platform is located in a space defined by the arch portion, and the arch portion is configured to abut against outer walls of two sides of the first positioning platform so as to limit movement of the arch portion; a support portion, wherein the support portion protrudes from the arch portion in the third direction, a notch is formed in the support portion, and the eccentric member is movably connected to the notch in the first direction and is rotatably connected to the notch; and two extension portions, wherein the two extension portions are respectively located on two sides of the arch portion in the second direction and are both connected to the arch portion, and each of the extension portions is rotatably connected to the first transmission assembly.

Optionally, the eccentric member comprises: a driving sleeve, wherein the driving sleeve is coaxially fixed to an output shaft of the second driving member; a crank, wherein an extension direction of the crank is perpendicular to the first direction, and one end of the crank is fixedly connected to the driving sleeve; and a steering shaft, wherein the other end of the crank is fixedly connected to the steering shaft, and the driving sleeve and the steering shaft are respectively located on two sides of the crank in the first direction; and the steering shaft is accommodated in the notch, and the steering shaft is capable of rotating in the notch.

Optionally, the first transmission assembly comprises: two positioning sleeves, wherein the two positioning sleeves are spaced apart in the second direction and are both rotatably connected to the first end portion; a first connection rod, wherein the first connection rod is located between the two positioning sleeves and is connected to the two positioning sleeves, the transmission rod is connected to the first connection rod, and the transmission rod is configured to rotate to drive the first connection rod and the two positioning sleeves to rotate; two ball-head rods, wherein each of the ball-head rods comprises a rod body and two connection heads, the rod body extends in the second direction, the two connection heads are respectively located at two ends of the rod body in the second direction, and each of the positioning sleeves is sleeved on one connection head of the corresponding ball-head rod and is fixed relative to the connection head; and two connection sleeves, wherein each of the connection sleeves and the corresponding positioning sleeve are spaced apart in the second direction, each of the connection sleeves is sleeved on the other connection head of the corresponding ball-head rod and is fixed relative to the other connection head, and each of the connection sleeves is configured to be connected to the corresponding first wheel.

Optionally, the first transmission assembly further comprises: two steering sleeves, wherein the two steering sleeves are spaced apart in the second direction, each of the steering sleeves is located on the side of the corresponding ball-head rod away from the corresponding positioning sleeve, each of the steering sleeves is sleeved on the corresponding connection sleeve, one end of each of the connection sleeves extends out of the corresponding steering sleeve in a direction away from the corresponding positioning sleeve and is connected to the corresponding first wheel, and the steering sleeves are rotatably connected to the first end portion and are rotatably connected to the steering frame.

Optionally, each of the steering sleeves comprises: a sleeve body, wherein the sleeve body is sleeved on the corresponding connection sleeve; a first protruding shaft, wherein the first protruding shaft protrudes from a peripheral wall of the sleeve body, the first protruding shaft is rotatably connected to the first end portion, an axial direction of the first protruding shaft coincides with a third direction, and the third direction is perpendicular to the first direction and the second direction; and an extension rod, wherein the extension rod protrudes from the peripheral wall of the sleeve body and is spaced apart from the first protruding shaft, the extension rod is rotatably connected to the steering frame, and an axial direction of a rotation center axis of the extension rod coincides with the third direction.

Optionally, further comprising a first end cover, wherein the first end cover is mounted at the first end portion, and the first end cover is configured to shield the first end portion from one side in the third direction; and each of the steering sleeves further comprises a second protruding shaft, the second protruding shaft protrudes from the peripheral wall of the sleeve body, the second protruding shaft is spaced apart from the first protruding shaft and is spaced apart from the extension rod, the second protruding shaft is rotatably connected to the first end cover, and an axial direction of the second protruding shaft coincides with the third direction.

Optionally, the first transmission assembly further comprises: a first driven gear, wherein the first driven gear is connected to the end of the transmission rod facing the first end portion; and a first face gear, wherein the first face gear is coaxially connected to the first connection rod or one of the positioning sleeves, and the first face gear is engaged with the first driven gear.

Optionally, a second positioning platform protrudes from the second end portion, and the transmission rod is rotatably connected to the second positioning platform; and the second transmission assembly comprises: a driving gear, wherein the driving gear is connected to the first driving member, and the first driving member is configured to drive the driving gear to rotate; a second driven gear, wherein the second driven gear is connected to the end of the transmission rod facing the second end portion, and the second driven gear is engaged with the driving gear; a third driven gear, wherein the third driven gear is connected to the end of the transmission rod facing the second end portion; a second connection rod, wherein the second connection rod extends in the second direction and is rotatably connected to the second end portion, one end of the second connection rod is connected to one of the second wheels, and the other end of the second connection rod is connected to the other second wheel; and a second face gear, wherein the second face gear is sleeved on the second connection rod and is coaxially connected to the second connection rod, and the second face gear is engaged with the third driven gear.

Optionally, further comprising a battery, wherein the battery is mounted at the middle body portion, and the battery is spaced apart from the second driving member in the second direction and is spaced apart from the first driving member in the first direction.

Optionally, the toy car further comprises: a protective shell, wherein the protective shell covers the first end portion, the second end portion and/or the middle body portion, the protective shell is configured to shield at least a part of a structure of the first driving member and to shield at least a part of a structure of the second driving member in a third direction, and the third direction is perpendicular to the first direction and the second direction.

Optionally, the toy car further comprises: a circuit board, wherein the circuit board is mounted on the protective shell and is located on the side of the protective shell facing away from the chassis.

Optionally, the toy car further comprises: a car shell, wherein the car shell is connected to the chassis and is configured to cover the chassis, the first driving member and the second driving member.

Optionally, the car shell comprises: a main shell body, wherein the main shell body is located on one side of the chassis in a third direction, the main shell body is configured to cover the chassis, the first driving member and the second driving member from one side in the third direction, and the third direction is perpendicular to the first direction and the second direction; and a split portion, wherein the split portion is arranged on the side of the chassis facing away from the main shell body, the split portion is connected to the main shell body, and the split portion is configured to be fitted with the main shell body so as to enable the car shell to be sleeved on the chassis.

The toy car provided in the embodiments of the present application are compact in structural layout, and the first driving member and the second driving member are arranged at the middle body portion, so that the situation that the mass and size of the first end portion are far greater than the mass and size of the second end portion can be reduced under the conditions that four-wheel driving traveling of the toy car is achieved and the first wheels are steerable, thereby improving the balance of the toy car during traveling, and reducing the rollover probability of the toy car during traveling. The first driving member and the second driving member are arranged in the same horizontal direction of the chassis, so that the overall height or thickness of the toy car can be the minimum, then the center of gravity of the entire toy car is lowered, and the operability of the toy car is further improved. At the same time, the structure of the present application has the characteristic of high adaptability, and can be adapted to various low-height sports car simulation models with space limitations, thereby increasing the degree of simulation of the toy car, and improving the playability of the toy car.

BRIEF DESCRIPTION OF THE DRAWINGS

In order to explain technical solutions of embodiments of the present application more clearly, drawings needed in the description of the embodiments will be briefly introduced below. Obviously, the drawings in the following description are some embodiments of the present application, and for those of ordinary skill in the art, other drawings can be obtained according to these drawings without involving any inventive effort.

DESCRIPTION OF REFERENCE NUMERALS IN THE DRAWINGS

100. toy car; 10. chassis; 11. first end portion; 12. second end portion; 13. middle body portion; 14. first positioning platform; 15. second positioning platform; 16. fixing ring; 20. first wheel; 30. second wheel; 40. protective shell; 41. first end cover; 42. second end cover; 43. battery cover; 44. steering engine cover; 50. circuit board; 61. first driving member; 62. first transmission assembly; 621. positioning sleeve; 6211. first connection groove; 622. first connection rod; 623. ball-head rod; 6231. rod body; 6232. connection head; 624. connection sleeve; 6241. second connection groove; 625. steering sleeve; 6251. sleeve body; 6252. first protruding shaft; 6253. second protruding shaft; 6254. extension rod; 626. first driven gear; 627. first face gear; 63. second transmission assembly; 631. driving gear; 632. second driven gear; 633. third driven gear; 634. second connection rod; 635. second face gear; 64. transmission rod; 70. steering mechanism; 71. second driving member; 72. eccentric member; 721. driving sleeve; 722. crank; 723. steering shaft; 73. steering frame; 731. arch portion; 732. support portion; 7321. notch; 733. extension portion; 80. battery; 90. car shell; 91. main shell body; and 92. split portion.

DETAILED DESCRIPTION OF EMBODIMENTS

The technical solutions in embodiments of the present application will be described clearly and completely below in conjunction with the accompanying drawings in the embodiments of the present application. Obviously, the described embodiments are only a part of embodiments of the present application, not all of them.

The term "and/or" in the present application is a description of the association relationship of the associated objects, indicating that there can be three relationships, for example, A and/or B can indicate that A exists alone, A and B exist at the same time, and B exists alone. The symbol "/" herein indicates that the associated objects are in an or relationship, for example, A/B indicates A or B.

"A plurality of" involved in the present application means two or more. In addition, it should be understood that the words "first", "second" and the like in the descriptions of the present application are only for the purpose of distinguishing the descriptions, cannot be understood as indicating or implying the relative importance, and cannot be understood as indicating or implying the sequence.

In the descriptions of the embodiments of the present application, the wording "exemplary" or "for example" are used to indicate an example, an illustration, or an explanation. In the embodiments of the present application, any embodiment or design scheme described as "exemplary" or "for example" should not be explained as more preferred or advantageous than other embodiments or design schemes. Exactly, the wording "exemplary" or "for example" is used to present a relevant concept in a specific manner.

Figure 1:
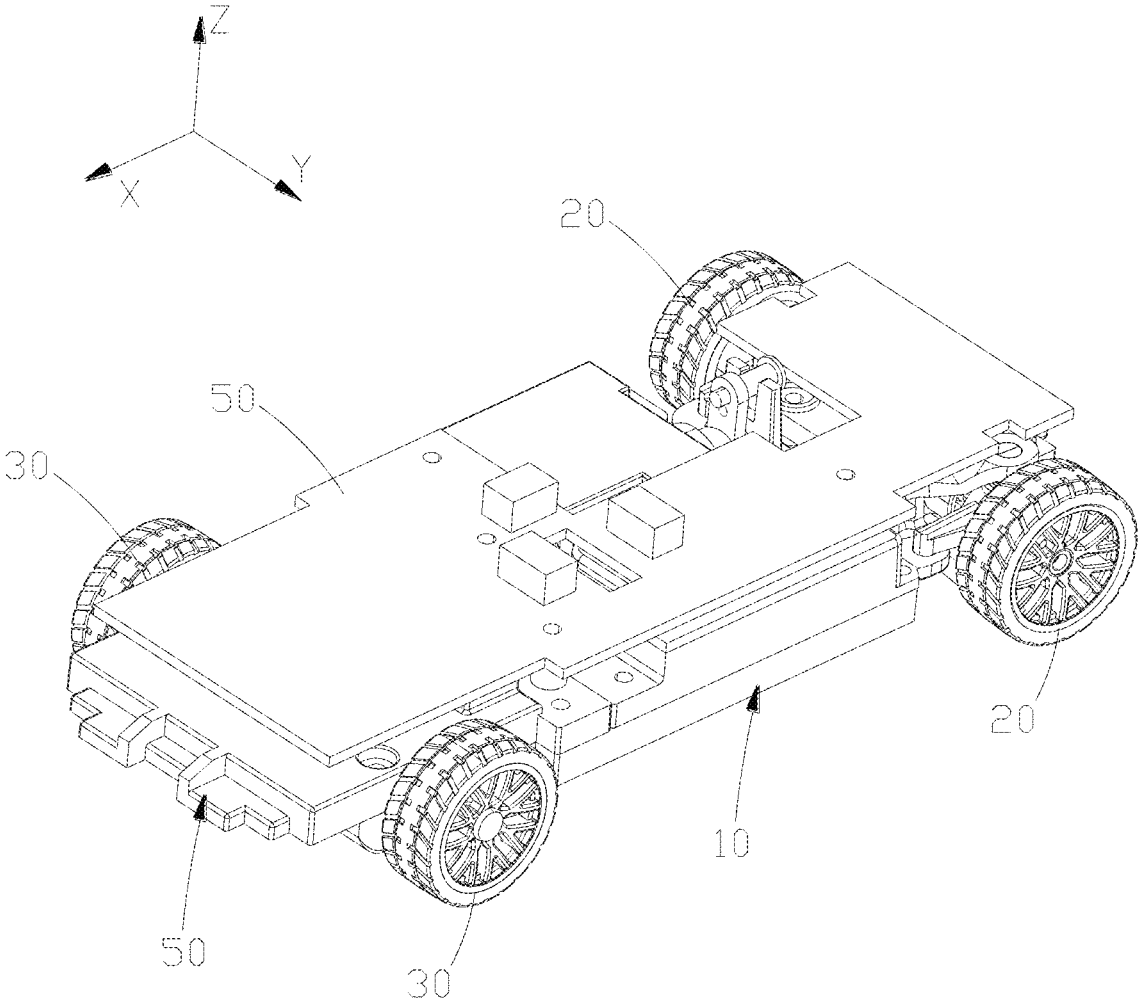
FIG. 1 is a first local structural schematic diagram of a toy car in an embodiment of the present application.
Figure 2:
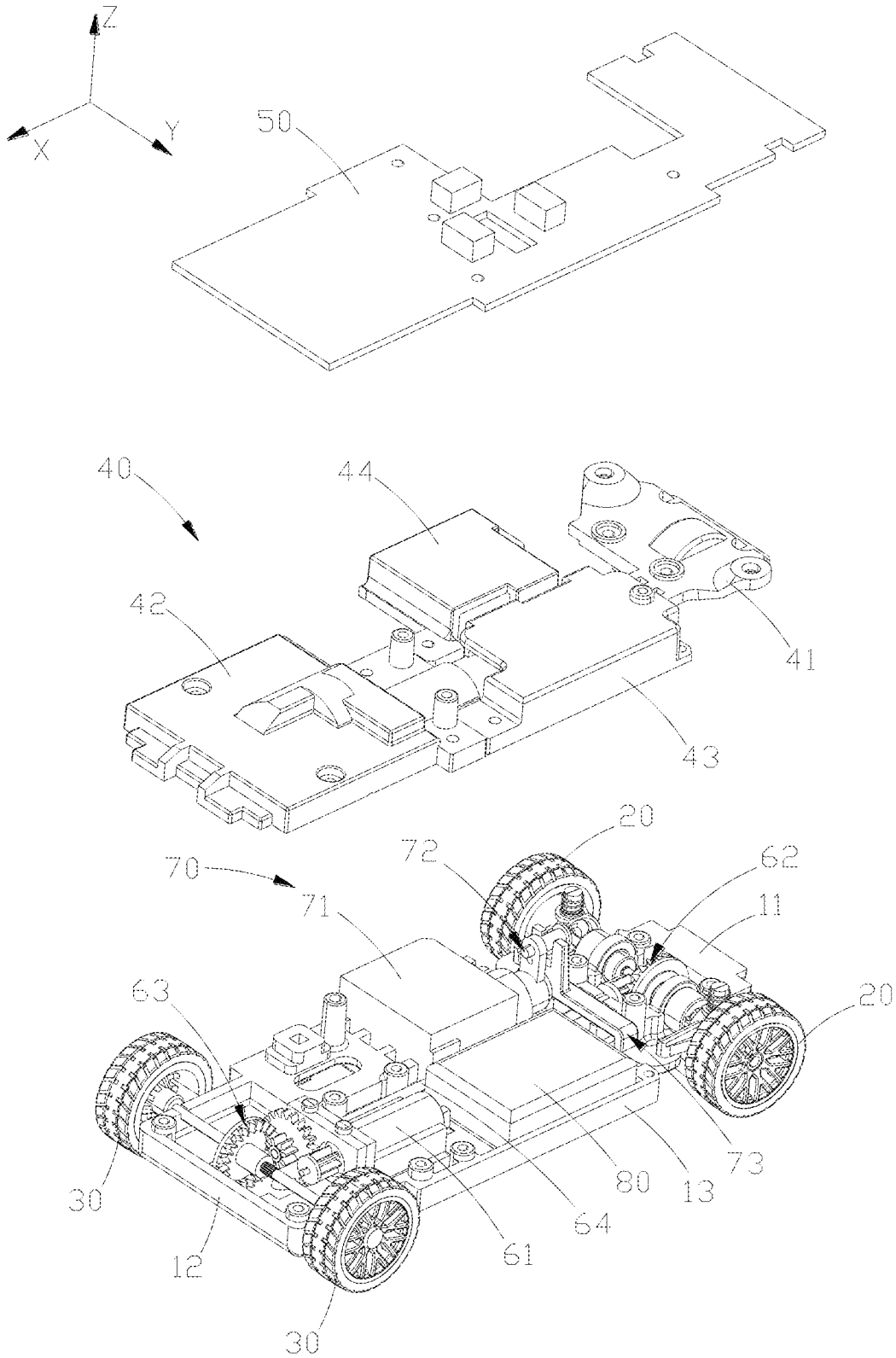
FIG. 2 is a first local structural disassembly diagram of a toy car in an embodiment of the present application.
Figure 10:
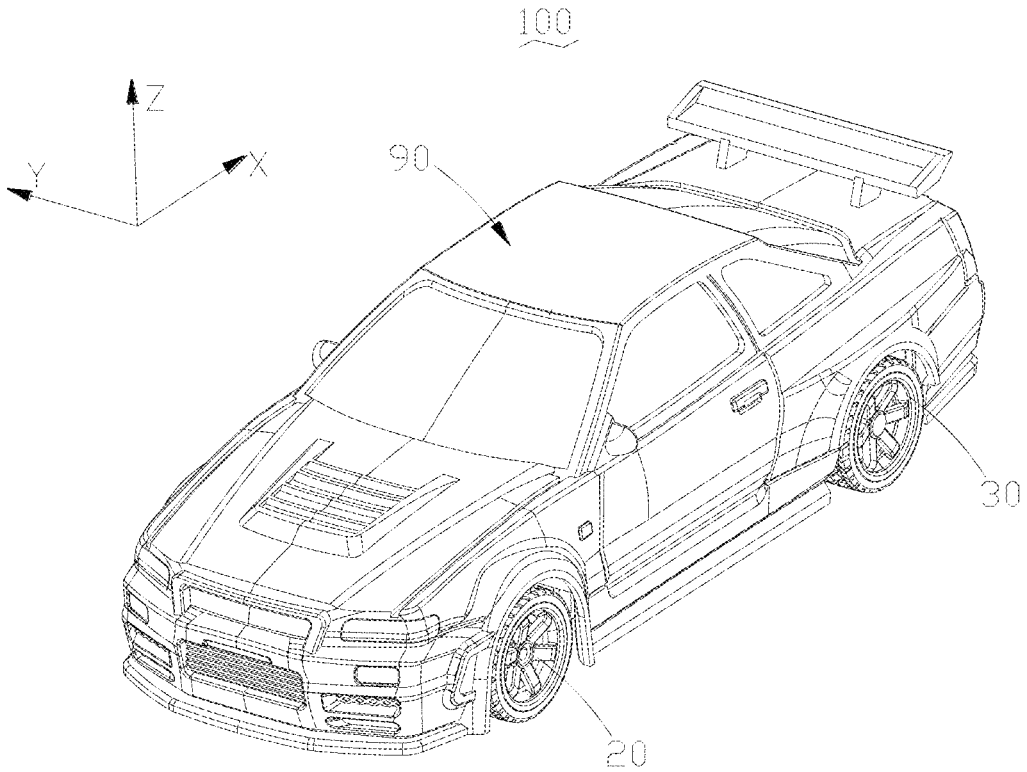
FIG. 10 is a first structural schematic diagram of a toy car in an embodiment of the present application.

Reference is made to FIG. 1 and FIG. 2, which show an internal structure of a toy car 100 (as shown in FIG. 10) provided in the embodiments of the present application. In the embodiments of the present application, a length direction of the toy car 100 is defined as a first direction, a width direction is defined as a second direction, and a height direction is defined as a third direction. As shown in FIG. 1 and FIG. 2, the first direction is an X direction and an opposite direction thereof, the second direction is a Y direction and an opposite direction thereof, and the third direction is a Z direction and an opposite direction thereof.

In an embodiment, the toy car 100 may include a chassis 10, two first wheels 20, two second wheels 30, a protective shell 40 and a circuit board 50.

The chassis 10 may include a first end portion 11, a second end portion 12 and a middle body portion 13. The first end portion 11 and the second end portion 12 are respectively located at two ends of the chassis 10 in the first direction, and the middle body portion 13 is located between the first end portion 11 and the second end portion 12. The two first wheels 20 are arranged at the first end portion 11 and spaced apart in the second direction, and the two second wheels 30 arranged at the second end portion 12 and spaced apart in the second direction. The two first wheels 20 and the two second wheels 30 are all rotatable, axial directions of the two first wheels 20 may coincide with the second direction, and axial directions of the two second wheels 30 may coincide with the second direction.

The protective shell 40 covers the chassis 10 from one side in the third direction. The protective shell 40 may shield at least a part of a structure of the second end portion 12 and at least a part of a structure of the middle body portion 13.

The circuit board 50 may be fixedly mounted on the protective shell 40. The circuit board 50 is located on the side of the protective shell 40 facing away from the chassis 10.

It can be understood that the circuit board 50 may be provided with electronic modules and electronic elements for cooperating with the toy car 100 to achieve functions such as traveling and turning, thereby cooperating with the mechanical structure of the toy car 100 to make the toy car 100 operate.

In the embodiments of the present application, the fixed mounting and the fixing manner during fixed mounting are not specifically limited. For example, the fixing manner may include but is not limited to screw fixing, buckle fixing, bonding fixing and integral molding fixing.

In the embodiments of the present application, whether the first wheels 20 and the second wheels 30 are specifically front wheels or rear wheels is not limited. For example, the first wheels 20 may be the front wheels, and the second wheels 30 may be the rear wheels. For another example, the first wheels 20 may be the rear wheels, and the second wheels 30 may be the front wheels.

In some embodiments, the toy car 100 may further include a driving mechanism, a steering mechanism 70 and a battery 80. The driving mechanism, the steering mechanism 70 and the battery 80 are all mounted on the chassis 10. The driving mechanism may include a first driving member 61, a first transmission assembly 62, a second transmission assembly 63 and a transmission rod 64. The first driving member 61 is fixedly mounted at the middle body portion 13, the first transmission assembly 62 is arranged at the first end portion 11, the second transmission assembly 63 is arranged at the second end portion 12, the transmission rod 64 extends in the first direction, and two ends of the transmission rod 64 are respectively connected to the first transmission assembly 62 and the second transmission assembly 63. The first driving member 61 may be connected to the transmission rod 64 and/or the second transmission assembly 63, and the first driving member 61 may drive the second transmission assembly 63 to move to enable the two second wheels 30 to rotate. At the same time, the first driving member 61 may drive the transmission rod 64 to rotate to enable the first transmission assembly 62 connected to the transmission rod 64 to move, so as to enable the two first wheels 20 to rotate.

The steering mechanism 70 may include a second driving member 71, an eccentric member 72 and a steering frame 73, and the second driving member 71 is fixedly mounted at the middle body portion 13 and is spaced apart from the first driving member 61 in the first direction and the second direction. The eccentric member 72 is fixedly connected to an output shaft of the second driving member 71. The steering frame 73 is arranged at the first end portion 11, and the steering frame 73 may be movably connected to the first end portion 11 in the first direction. The steering frame 73 is rotatably connected to the first transmission assembly 62. The eccentric member 72 is relatively movably connected to the steering frame 73, and the eccentric member 72 and the steering frame 73 may move relatively in the first direction and may move relatively in the third direction. The eccentric member 72 may also be relatively rotatably connected to the steering frame 73, and an axial direction of a central axis of rotation of the eccentric member 72 coincides with the first direction. A connection point of the eccentric member 72 with the second driving member 71 is spaced apart from a connection point with the steering frame 73. The second driving member 71 may drive the eccentric member 72 to rotate, so that the eccentric member 72 rotates and moves relative to the steering frame 73, thereby driving the steering frame 73 to move at the first end portion 11; and by means of the movement of the steering frame 73, the first transmission assembly 62 may rotate relative to the steering frame 73, thereby achieving turning of the two first wheels 20 connected to the first transmission assembly 62.

The battery 80 may be fixedly mounted at the middle body portion 13. The battery 80 may be spaced apart from the second driving member 71 in the second direction, and may be spaced apart from the first driving member 61 in the first direction.

In the embodiments of the present application, components such as the first driving member 61, the second driving member 71, the steering mechanism 70 and the battery 80 are arranged in the same horizontal direction, so that the structural layout is more compact, that is, the mounting space is compressed in a vertical direction, thus the overall structure of the toy car is minimized, and then the purpose of increasing the space utilization rate is achieved. In other words, the height or thickness of the toy car in the present application may be the minimum. It can be expected to lower the center of gravity of the toy car in the present application, so that the toy car has the higher stability during traveling. On the other hand, the structure of the present application has the purpose of high adaptability, and can be adapted to various low-height sports car simulation models with space limitations, thereby increasing the degree of simulation of the toy car, and improving the playability of the toy car.

It can be understood that the protective shell 40 may shield at least a part of a structure of the first transmission assembly 62, at least a part of a structure of the second transmission assembly 63, the first driving member 61, the battery 80 and the second driving member 71 from one side in the third direction.

It can be understood that the first driving member 61 and the second driving member 71 are both electronic driving members that can drive objects to rotate. In the embodiments of the present application, the types of the first driving member 61 and the second driving member 71 are not specifically limited. For example, the first driving member 61 may be a motor, and the second driving member 71 may be a steering engine with a built-in reduction gear set.

Figure 3:
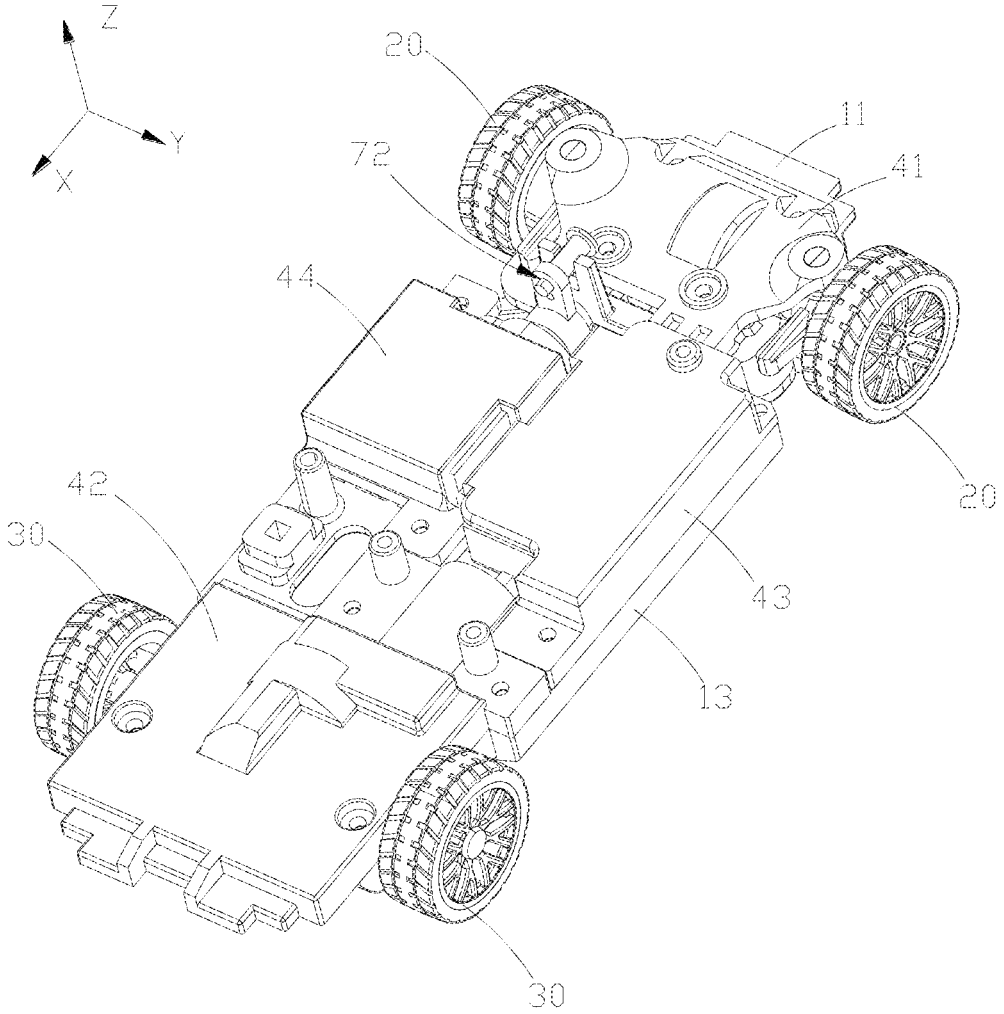
FIG. 3 is a second local structural schematic diagram of a toy car in an embodiment of the present application.

Reference is also made to FIG. 3. For example, the protective shell 40 may include a first end cover 41, a second end cover 42, a battery cover 43 and a steering engine cover 44. The first end cover 41 is fixedly mounted at the first end portion 11, and the first end cover 41 can shield the first transmission assembly 62. The second end cover 42 is fixedly mounted at the second end portion 12, a part of a cover body of the second end cover 42 extends to the middle body portion 13 and is fixedly connected to the middle body portion 13, and the second end cover 42 may shield the second transmission assembly 63 and the first driving member 61 and may also shield a part of a structure of the transmission rod 64. The battery cover 43 may be fixedly mounted at the middle body portion 13, and the battery cover 43 may cover the battery 80. The battery cover 43 may limit the movement of the battery 80 after being fixedly connected to the middle body portion 13, thereby achieving fixed mounting of the battery 80 at the middle body portion 13. The steering engine cover 44 may be fixedly mounted at the middle body portion 13, and the steering engine cover 44 may cover a body of the second driving member 71. The steering engine cover 44 may limit the movement of the second driving member 71 after being fixedly connected to the middle body portion 13, thereby achieving fixed mounting of the second driving member 71 at the middle body portion 13.

It can be understood that the battery 80, the first driving member 61 and the second driving member 71 are all arranged at the middle body portion 13, the first transmission assembly 62 is arranged at the first end portion 11, and the second transmission assembly 63 is arranged at the second end portion 12, thereby reducing the situation that the weight of one end of the toy car 100 is far greater than the weight of the other end, reducing the situation that the size of one end of the toy car 100 is far greater than the size of the other end, improving the balance of the toy car 100 during traveling, and reducing the rollover probability of the toy car 100 during turning or acceleration; at the same time, by means of the increase of the mass of the middle body portion 13 and the balance of the weight of the two ends of the toy car 100, the stability of the toy car 100 during traveling can be improved, and the rollover probability of the toy car 100 during traveling can be reduced.

Figure 4:
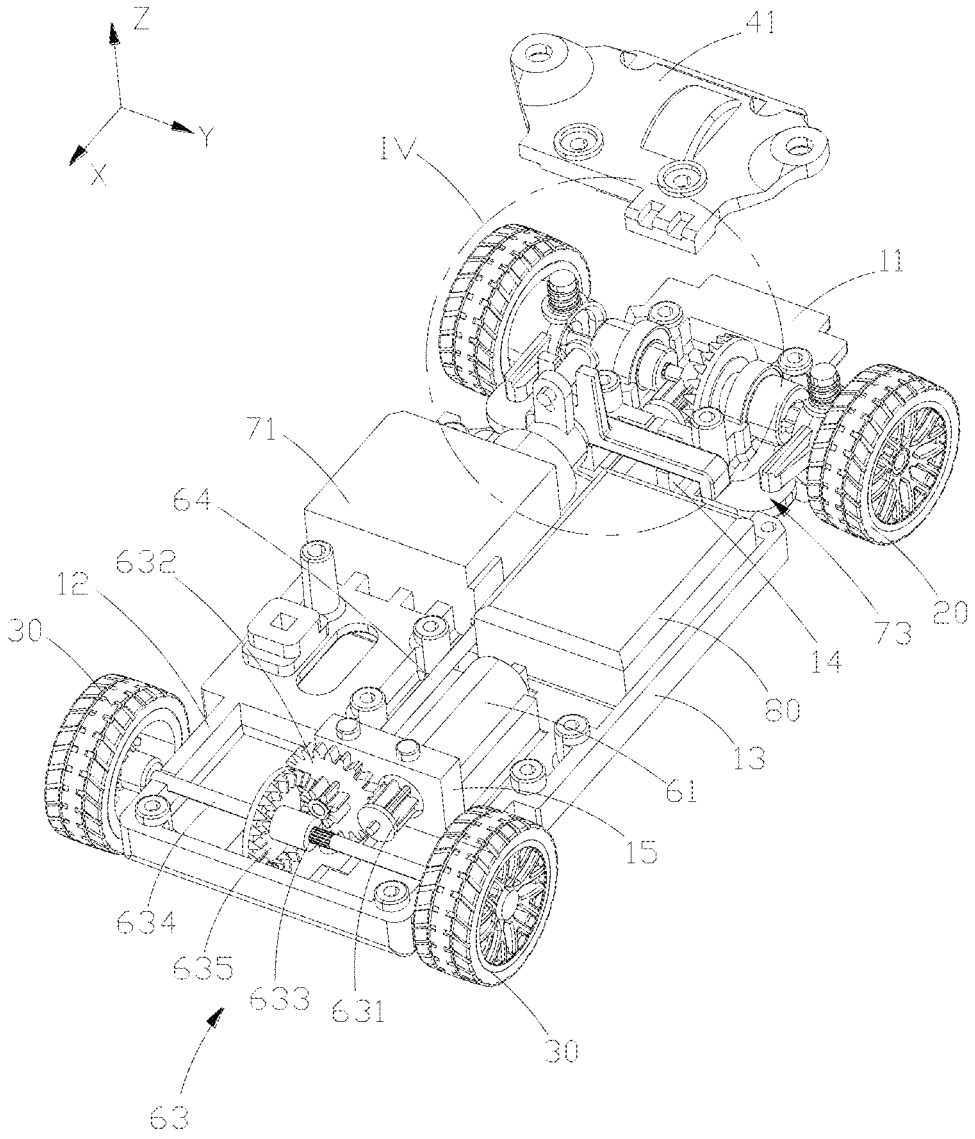
FIG. 4 is a second local structural disassembly diagram of a toy car in an embodiment of the present application.
Figure 5:
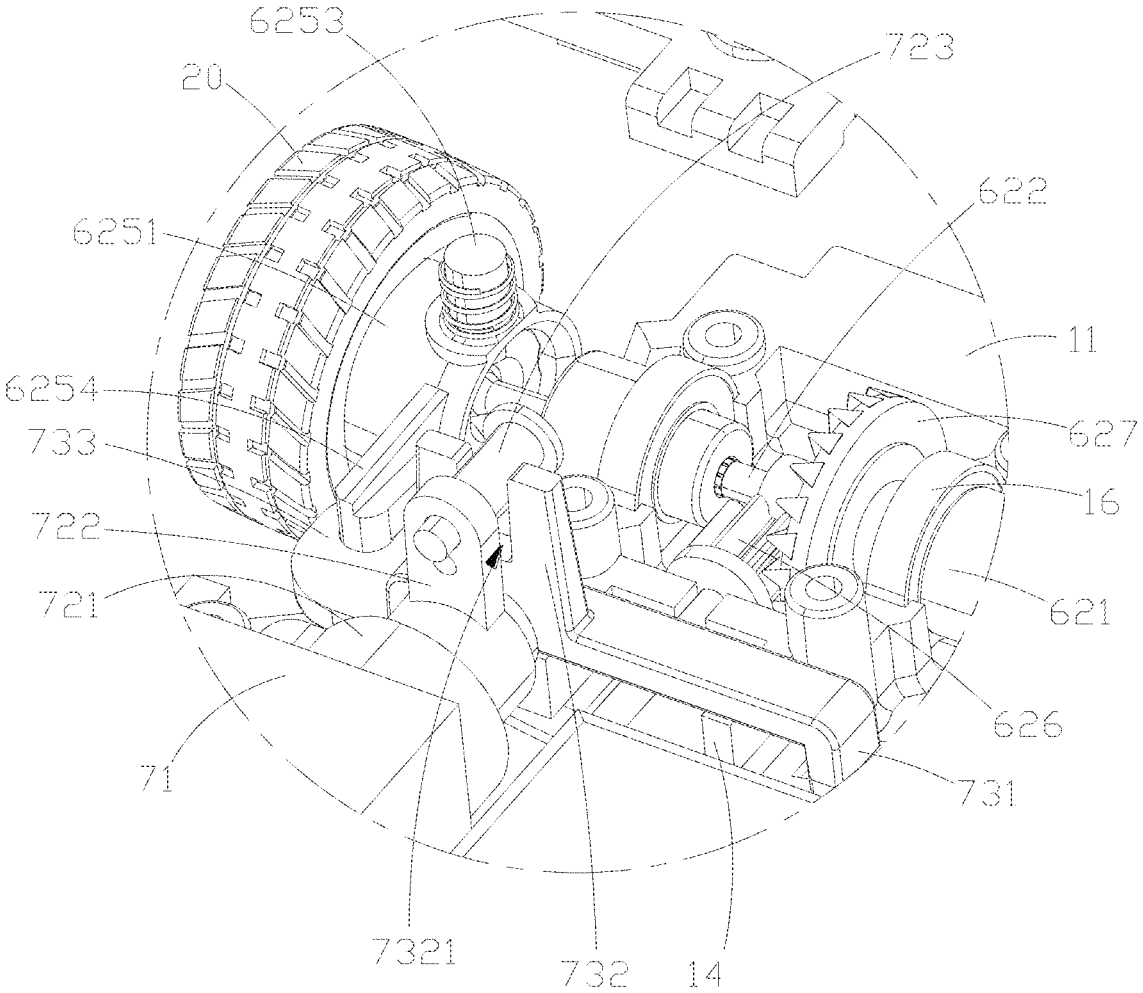
FIG. 5 is an enlarged view at V in FIG. 4.

Reference is also made to FIG. 4 and FIG. 5, in some embodiments, a first positioning platform 14 and a second positioning platform 15 protrude from the chassis 10 in the third direction, the first positioning platform 14 is located at a junction of the middle body portion 13 and the first end portion 11, and the second positioning platform 15 is located at a junction of the middle body portion 13 and the second end portion 12, that is, the first positioning platform 14 and the second positioning platform 15 are spaced apart in the first direction. The transmission rod 64 may penetrate through the first positioning platform 14 and the second positioning platform 15 and is rotatably connected to the first positioning platform 14 and/or the second positioning platform 15. One end of the first driving member 61 may abut against the second positioning platform 15, and an output shaft of the first driving member 61 may penetrate through the second positioning platform 15 and is rotatably connected to the second positioning platform 15.

Figure 6:
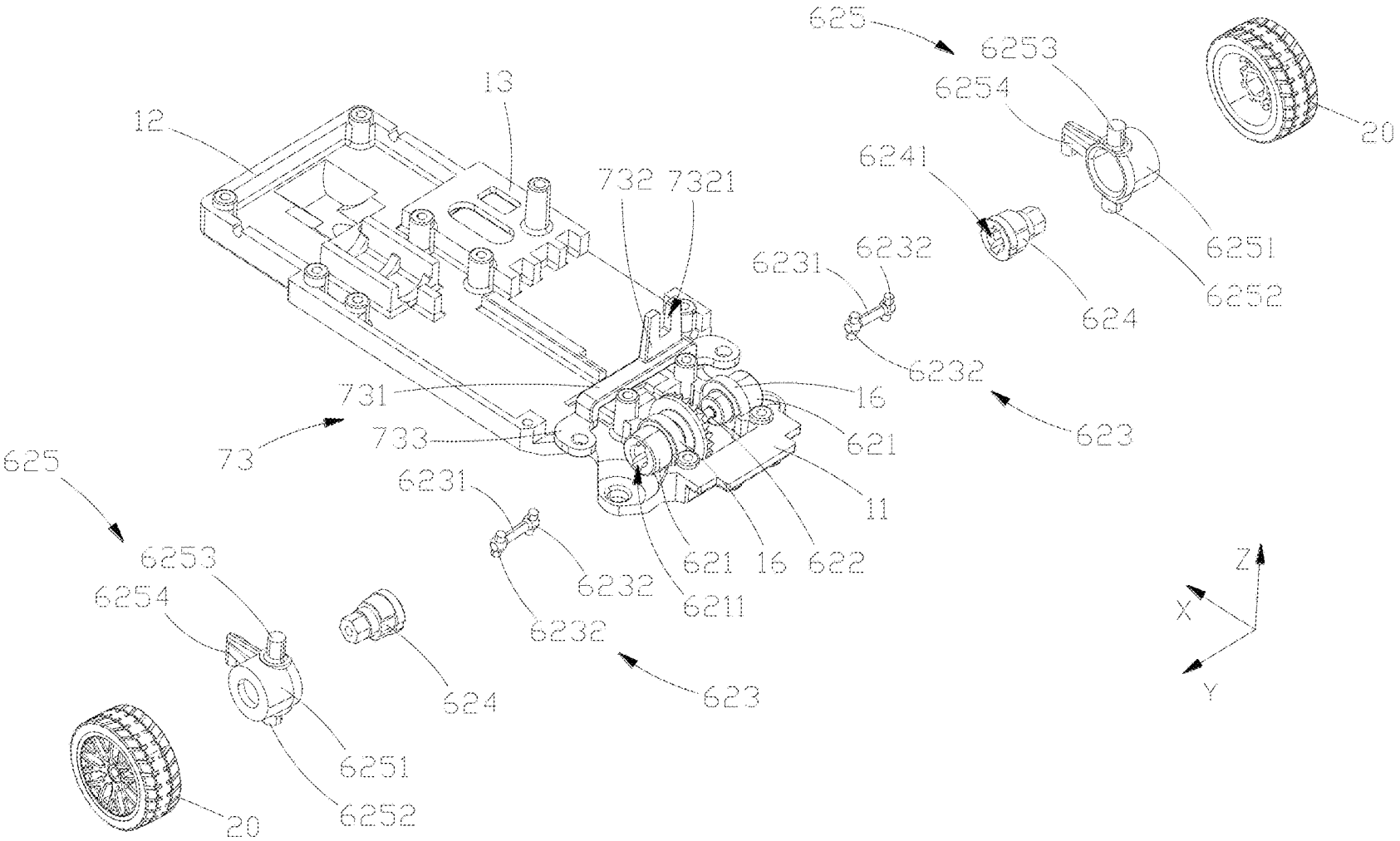
FIG. 6 is a third local structural disassembly diagram of a toy car in an embodiment of the present application.
Figure 7:
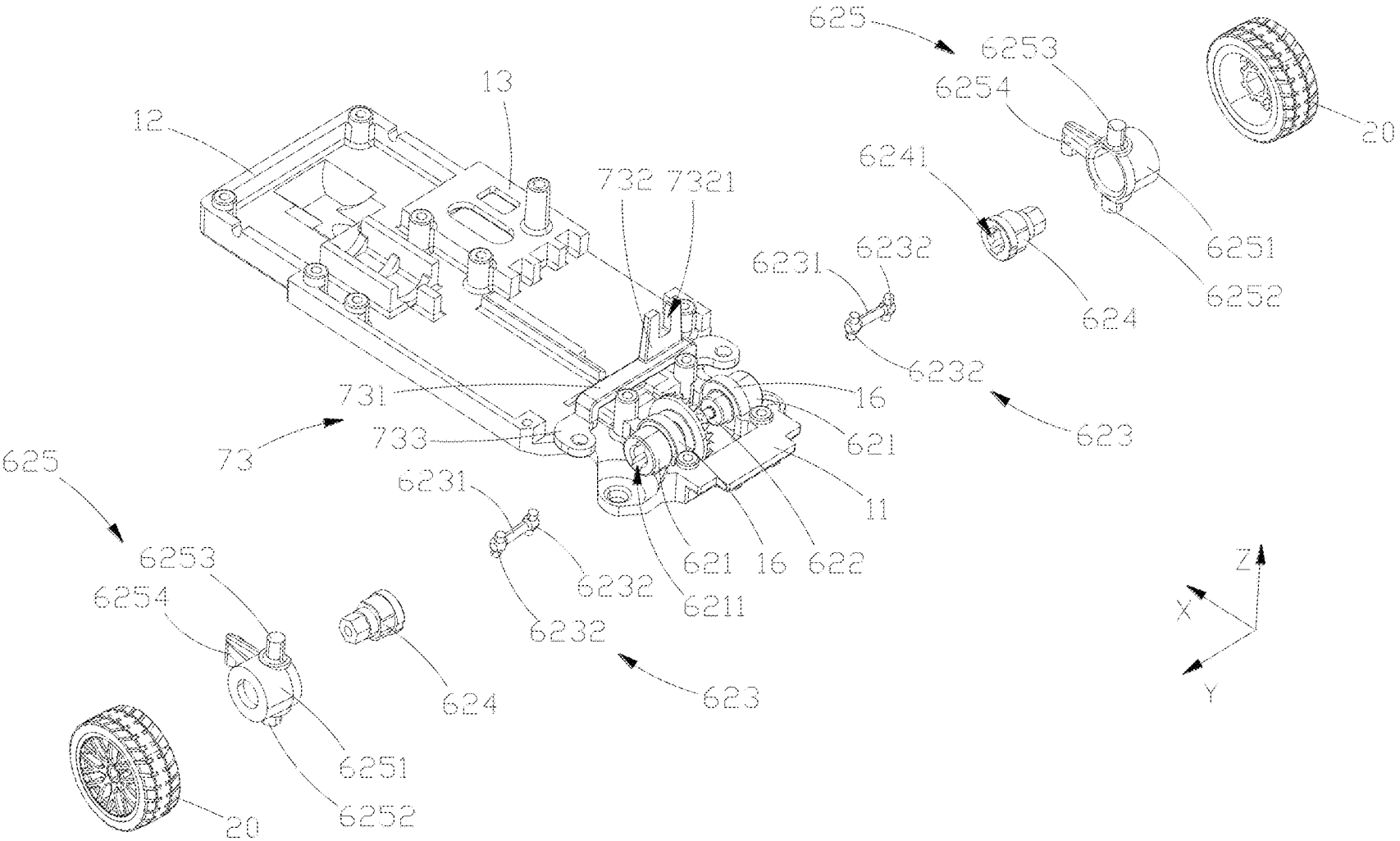
FIG. 7 is a fourth local structural disassembly diagram of a toy car in an embodiment of the present application.

Reference is also made to FIG. 6 and FIG. 7, in some embodiments, the first transmission assembly 62 may include positioning sleeves 621, a first connection rod 622, ball-head rods 623, connection sleeves 624 and steering sleeves 625. There are two positioning sleeves 621, two ball-head rods 623, two connection sleeves 624 and two steering sleeves 625, and the two positioning sleeves 621, the two ball-head rods 623, the two connection sleeves 624 and the two steering sleeves 625 correspond to one another on a one-to-one basis.

Two fixing rings 16 are fixedly connected to the first end portion 11, and the two fixing rings 16 are spaced apart in the second direction. One positioning sleeve 621 is accommodated in each fixing ring 16. The positioning sleeves 621 are rotatably connected to the corresponding fixing rings 16 so as to be rotatably connected to the first end portion 11. The two positioning sleeves 621 are spaced apart in the second direction, and the two positioning sleeves 621 are coaxial with each other. Axial directions of the two positioning sleeves 621 coincide with the second direction. The first connection rod 622 extends in the second direction, and two ends of the first connection rod 622 are respectively fixedly connected to the two positioning sleeves 621.

Each ball-head rod 623 is located on one side of the corresponding positioning sleeve 621 facing away from the other positioning sleeve 621. Each ball-head rod 623 includes a rod body 6231 and two connection heads 6232. The rod body 6231 extends in the second direction. The two connection heads 6232 are respectively fixedly connected to two ends of the rod body 6231. Each connection head 6232 includes a ball head and two protrusions. The ball head is fixedly connected to the rod body 6231. The two protrusions protrude from the ball head, the two protrusions are spaced apart in a circumferential direction, and a protruding direction of each protrusion is perpendicular to the second direction. A first connection groove 6211 may be formed in the side of each positioning sleeve 621 facing away from the other positioning sleeve 621, and the first connection groove 6211 may be sleeved on one connection head 6232 of the corresponding ball-head rod 623. The ball head may be universally rotatably connected to the corresponding first connection groove 6211, and the two protrusions may be accommodated in the corresponding first connection groove 6211. The forming shape of the first connection groove 6211 may be adapted to the shape of the corresponding connection head 6232, so that when the connection head 6232 universally rotates in the first connection groove 6211, the two protrusions may abut against an inner wall of the first connection groove 6211, and when the positioning sleeve 621 rotates and an axial direction of a central axis of rotation of the positioning sleeve 621 coincides with the second direction, the corresponding ball-head rod 623 may rotate synchronously. In addition, when the ball-head rod 623 rotates synchronously with the positioning sleeve 621, the connection head 6232 may rotate relative to the positioning sleeve 621 in the first connection groove 6211.

The two connection sleeves 624 are spaced apart in the second direction, each connection sleeve 624 is located on the side of the corresponding positioning sleeve 621 facing away from the other positioning sleeve 621, and each connection sleeve 624 and the corresponding positioning sleeve 621 are spaced apart in the second direction. A second connection groove 6241 may be formed in the side of each connection sleeve 624 facing the other connection sleeve 624, and the second connection groove 6241 may be sleeved on one connection head 6232 of the corresponding ball-head rod 623. The ball head may be universally rotatably connected to the corresponding second connection groove 6241, and the two protrusions may be accommodated in the corresponding second connection groove 6241. The forming shape of the second connection groove 6241 may be adapted to the shape of the corresponding connection head 6232, so that when the connection head 6232 universally rotates in the second connection groove 6241, the two protrusions may abut against an inner wall of the second connection groove 6241, and when the ball-head rod 623 rotates synchronously with the positioning sleeve 621, the corresponding connection sleeve 624 may rotate synchronously. In addition, when the connection sleeve 624 rotates with the ball-head rod 623, the connection head 6232 may rotate relative to the connection sleeve 624 in the second connection groove 6241.

The two steering sleeves 625 are spaced apart in the second direction, each steering sleeve 625 is located on the side of the corresponding positioning sleeve 621 facing away from the other positioning sleeve 621, and each steering sleeve 625 is spaced apart from the corresponding positioning sleeve 621 and the ball-head rod 623 in the second direction. Each steering sleeve 625 is sleeved on the corresponding connection sleeve 624, the connection sleeve 624 penetrates through the corresponding steering sleeve 625, and the connection sleeve 624 is rotatably connected to the corresponding steering sleeve 625. The end of the connection sleeve 624 away from the corresponding positioning sleeve 621 extends out of the corresponding steering sleeve 625 and is fixedly connected to the corresponding first wheel 20. Thus, when the first connection rod 622 and the two positioning sleeves 621 rotate, the two ball-head rods 623, the two connection sleeves 624 and the two first wheels 20 may rotate synchronously.

In some embodiments, each steering sleeve 625 may include a sleeve body 6251, a first protruding shaft 6252, a second protruding shaft 6253 and an extension rod 6254. The sleeve body 6251 is annular and is sleeved on the corresponding connection sleeve 624. The first protruding shaft 6252 and the second protruding shaft 6253 protrude from a peripheral wall of the sleeve body 6251, and the first protruding shaft 6252 is spaced apart from the second protruding shaft 6253 in a circumferential direction of the sleeve body 6251. The first protruding shaft 6252 penetrates through the first end portion 11 in the third direction and is rotatably connected to the first end portion 11. The second protruding shaft 6253 penetrates through the first end cover 41 in the third direction and is rotatably connected to the first end cover 41. The first protruding shaft 6252 is movably connected to the first end portion 11 in the third direction. The second protruding shaft 6253 is movably connected to the first end cover 41 in the third direction, the second protruding shaft 6253 is sleeved with a spring, and the spring may abut against the sleeve body 6251 and the first end cover 41.

The extension rod 6254 protrudes from the peripheral wall of the sleeve body 6251 and is spaced apart from the first protruding shaft 6252 and the second protruding shaft 6253. A protruding direction of the extension rod 6254 is perpendicular to the second direction. The end of the extension rod 6254 away from the sleeve body 6251 may form a protruding shaft, and the end of the extension rod 6254 away from the sleeve body 6251 is rotatably connected to the steering frame 73.

It can be understood that the two steering sleeves 625, the two springs and the first end cover 41 may be fitted to form a damping system of the toy car 100.

It can be understood that the positioning sleeves 621, the ball-head rods 623 and the connection sleeves 624 may be combined to form a driving shaft connected to the first wheels 20, and the driving shaft may drive the first wheels 20 to rotate synchronously when rotating. When the first wheels 20 and the driving shaft rotate around central axes of the first wheels 20, the ball-head rods 623 and the steering sleeves 625 may rotate synchronously around central axes with axial directions coinciding with the third direction. In addition, when rotation angles are large, the connection sleeves 624 may be driven to turn around synchronously to drive the first wheels 20 to turn around synchronously, thereby achieving turning of the first wheels 20.

The driving shaft formed by fitting the positioning sleeves 621, the ball-head rods 623 and the connection sleeves 624 may transmit steering power to the first wheels 20 to turn the first wheels 20 when transmitting traveling power to the first wheels 20 to rotate the first wheels 20.

It can be understood that as shown in FIG. 6 and FIG. 7, the positioning sleeves 621, the first connection rod 622, the ball-head rods 623, the connection sleeves 624 and the steering sleeves 625 may be arranged in the second direction. The second direction may be the width direction of the toy car 100, and the third direction may be the height direction of the toy car 100, that is, the structures for achieving the turning function of the first wheels 20 are arranged in the width direction of the toy car 100. Thus, the situation that the structures for turning the toy car 100 are stacked on the chassis 10 in the third direction may be avoided, the height of the toy car 100 may be reduced, and the stability of the toy car 100 during traveling may be improved. At the same time, when a worker designs the toy car 100 by scaling down a car according to the actual size of the car, the situation that the structures in the toy car 100 are stacked in the third direction is reduced, so that the lower limit of the height of the toy car 100 in the third direction may be reduced, and the worker can design the toy car 100 in the smaller scale. For example, when the worker designs the toy car 100 provided in the embodiments of the present application by scaling down the car according to the actual size of the car, the ratio of the size of the toy car 100 to the actual size of the car may be greater than or equal to 1:43.

In some embodiments, the first transmission assembly 62 may further include a first driven gear 626 and a first face gear 627. The first face gear 627 is coaxially fixed to the first connection rod or one positioning sleeve 621. The first driven gear 626 is arranged at the end of the transmission rod 64 facing the first end portion 11 and is coaxially fixed to the transmission rod 64. The first driven gear 626 is engaged with the first face gear 627.

It can be understood that the first driving member 61 may drive the transmission rod 64 to rotate, thereby driving the first driven gear 626 and the first face gear 627 to rotate so as to rotate the two positioning sleeves 621, the two ball-head rods 623 and the two connection sleeves 624 to achieve the movement of the first transmission assembly 62. Thus, the two first wheels 20 may rotate synchronously with the two connection sleeves 624, and the first driving member 61 may drive the two first wheels 20 to rotate.

It can be understood that the size of the toy car 100 is small, and a space for arranging components in the first end portion 11 is small, so that the common means in the related field is to provide the first end portion 11 with a transmission assembly formed by a gear set and a connection rod, thereby achieving four-wheel driving traveling of the toy car 100; or the common means is to provide the first end portion with a driving member and a steering assembly with a ball-head connection rod, thereby achieving turning of the toy car 100. In the toy car 100 provided in the embodiments of the present application, the second driving member 71 is arranged at the middle body portion 13 to increase the space at the first end portion 11, so that the first transmission assembly 62 may be completely mounted at the first end portion 11. The driving shaft formed by combining the positioning sleeves 621, the ball-head rods 623 and the connection sleeves 624 in the first transmission assembly 62, the first driven gear 626 and the first face gear 627 may cooperate to transmit the traveling power to the first wheels 20, and the steering sleeves 625, the ball-head rods 623 and the connection sleeves 624 in the first transmission assembly 62 may cooperate to transmit the steering power to the first wheels 20, so that synchronous driving for rotation and turning of the two first wheels 20 may be achieved by one transmission assembly, and the toy car 100 provided in the embodiments of the present application may turn under the condition of four-wheel driving traveling.

In some embodiments, the second transmission assembly 63 includes a driving gear 631, a second driven gear 632, a third driven gear 633, a second connection rod 634 and a second face gear 635. The driving gear 631 is coaxially fixed to the output shaft of the first driving member 61 and is located on the side of the second positioning platform 15 facing away from the first end portion 11. The second driven gear 632 is arranged at the end of the transmission rod 64 facing the second end portion 12 and is coaxially fixed to the transmission rod 64. The second driven gear 632 is engaged with the driving gear 631. The third driven gear 633 is arranged at the end of the transmission rod 64 facing the second end portion 12 and is coaxially fixed to the transmission rod 64. The diameter of the third driven gear 633 is smaller than the diameter of the second driven gear 632, and the third driven gear 633 is located on the side of the second driven gear 632 facing away from the first end portion 11. The second connection rod 634 extends in the second direction, and two ends of the second connection rod 634 are respectively coaxially fixed to the two second wheels 30. The second connection rod 634 is rotatably connected to the second end portion 12. The second face gear 635 is sleeved on the second connection rod 634 and is coaxially fixed to the second connection rod 634, and the second face gear 635 is engaged with the third driven gear 633.

It can be understood that the first driving member 61 may drive the driving gear 631 to rotate, thereby rotating the second driven gear 632 and the transmission rod 64. When the transmission rod 64 rotates, the third driven gear 633 rotate synchronously, thereby rotating the second face gear 635, the second connection rod 634 and the two second wheels 30 synchronously. Thus, the first driving member 61 may operate to achieve synchronous rotation of the two first wheels 20 and the two second wheels 30, thereby achieving four-wheel driving traveling of the toy car 100.

It can be understood that the gear set is arranged at the first end portion 11 to achieve rotation of the first wheels 20, and the gear set is arranged at the second end portion 12 to achieve rotation of the second wheels 30, that is, the first driving member 61 drives the first wheels 20 and the second wheels 30 to rotate in a gear transmission manner, so that the stability of power output of the first driving member 61 to the first wheels 20 and the second wheels 30 can be improved.

Figure 8:
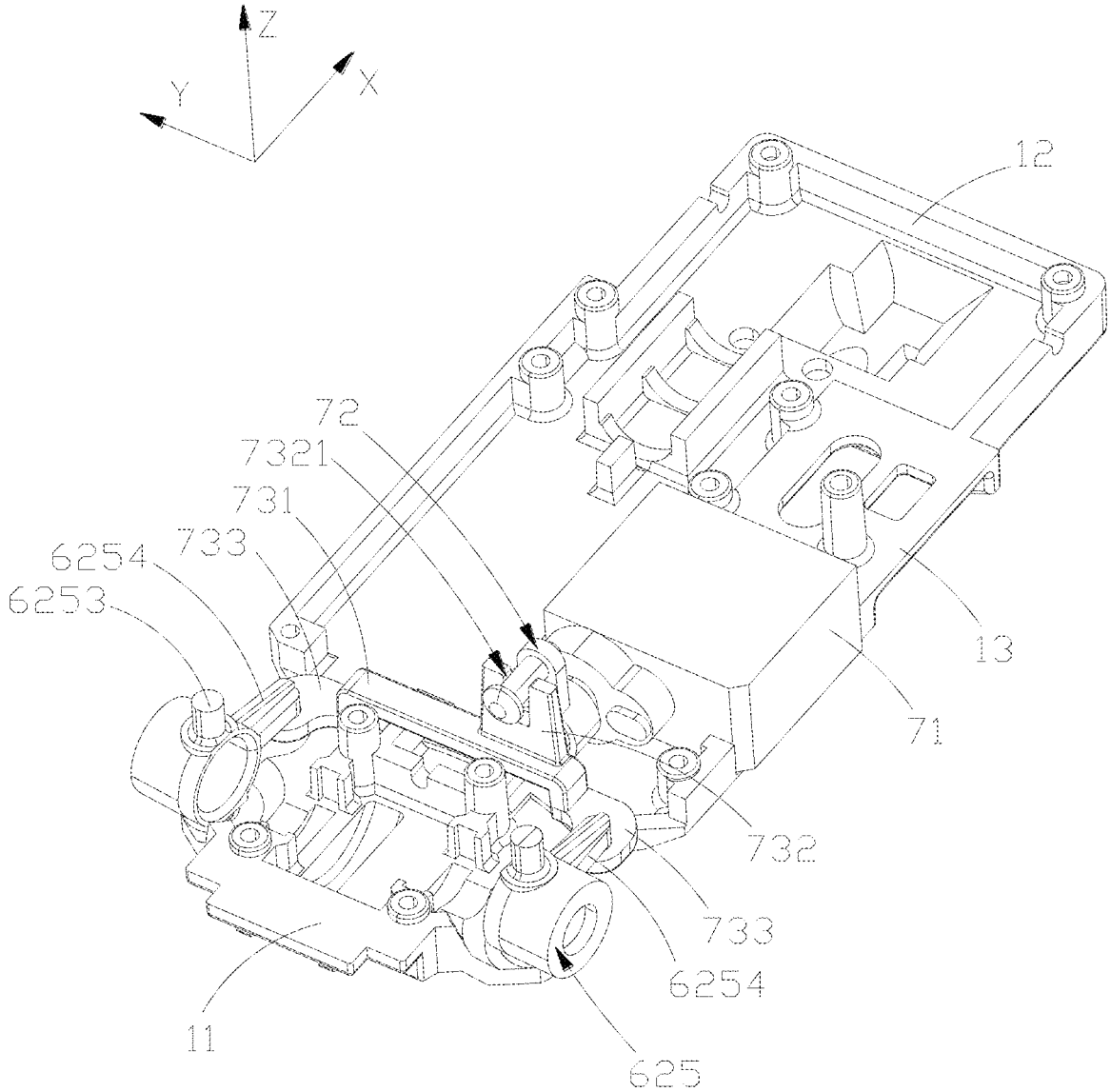
FIG. 8 is a third local structural schematic diagram of a toy car in an embodiment of the present application.
Figure 9:
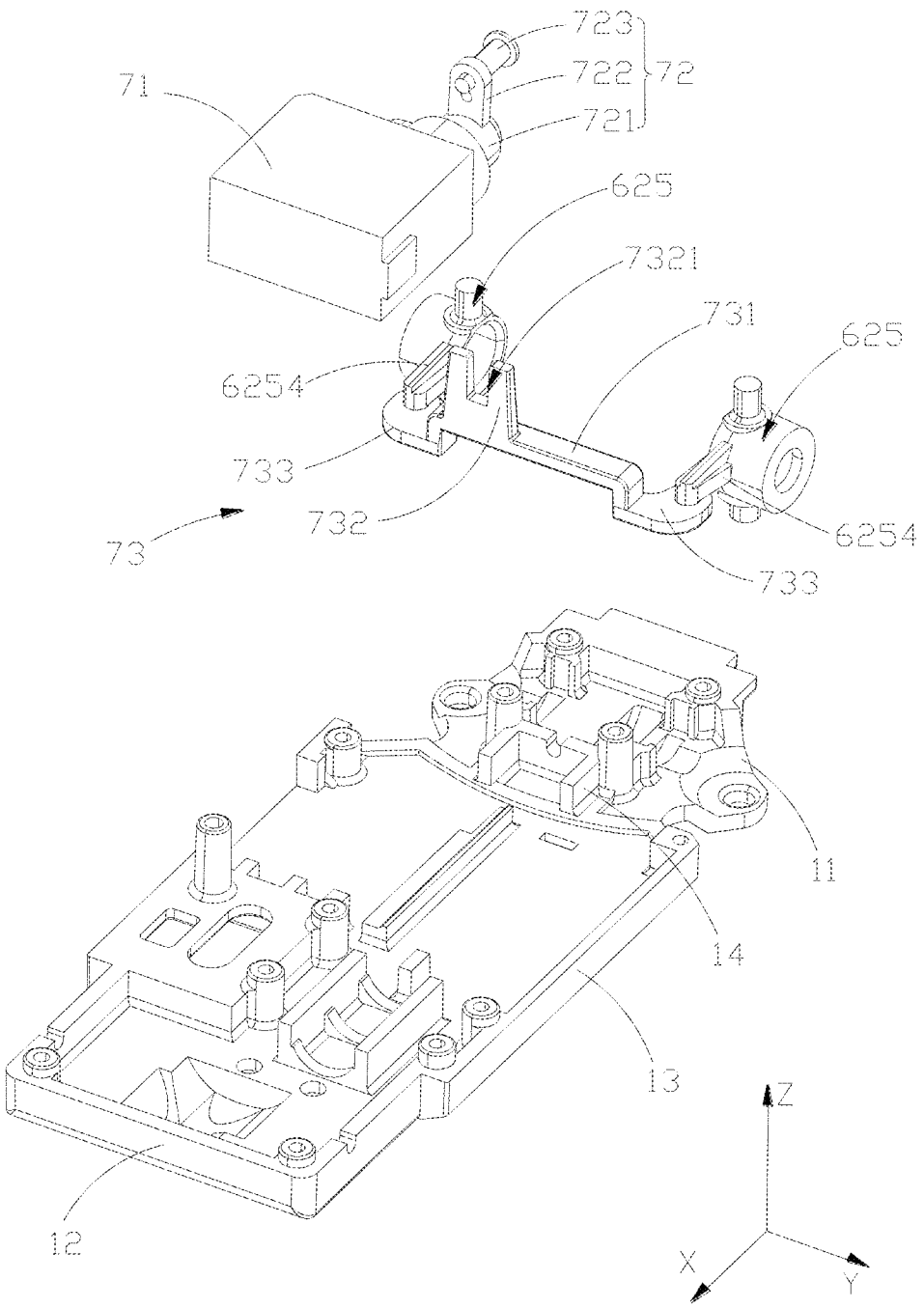
FIG. 9 is a fifth local structural disassembly diagram of a toy car in an embodiment of the present application.

Reference is also made to FIG. 8 and FIG. 9, in some embodiments, the steering frame 73 includes an arch portion 731, a support portion 732 and two extension portions 733. The arch portion 731 is arranged around the first positioning platform 14, and the arch portion 731 shields a part of the first positioning platform 14 from one side in the third direction and two sides in the second direction. Outer walls of two sides of the arch portion 731 in the second direction may abut against the first positioning platform 14, and the first positioning platform 14 may limit the movement of the arch portion 731 in the second direction. The support portion 732 protrudes from the arch portion 731 in the third direction and is spaced apart from the first positioning platform 14 in the third direction. A notch 7321 is formed in the support portion 732. The notch 7321 penetrates through the support portion 732 in the first direction. The notch 7321 can accommodate a part of a structure of the eccentric member 72. The eccentric member 72 may be slidably connected to the notch 7321 in the third direction and may be rotatably connected to the notch 7321. The two extension portions 733 are respectively located on two sides of the arch portion 731 in the second direction and are integrally formed with and fixed to the arch portion 731. The two extension portions 733 correspond to the two steering sleeves 625 on a one-to-one basis. The protruding shaft of each extension rod 6254 penetrates through the corresponding extension portion 733 in the third direction and is rotatably connected to the corresponding extension portion 733.

In the embodiments of the present application, the shape of the notch 7321 is not specifically limited. For example, the notch 7321 may be a U-shaped opening, and the notch 7321 may penetrate through the side of the support portion 732 facing away from the chassis 10 in the third direction. For another example, the notch 7321 may be an O-shaped opening, and the notch 7321 does not penetrate through the support portion 732 in a direction (for example, the second direction and the third direction) perpendicular to the first direction.

It can be understood that when the second driving member 71 drives the eccentric member 72 to rotate, the end of the eccentric member 72 connected to the support portion 732 moves in a circumferential direction. The eccentric member 72 may push the steering frame 73 to move in the second direction, and at the same time, the end of the eccentric member 72 connected to the support portion 732 rotates in the notch 7321 and moves in the third direction. During the process of the steering frame 73 moving in the second direction, the two steering sleeves 625 rotatably connected to the steering frame 73 may rotate relative to the steering frame 73, and the steering frame 73 is relatively fixed to the first end portion 11, so that the steering frame 73 may move in the first direction while rotating relative to the two steering sleeves 625, that is, the steering frame 73 may move synchronously in the first direction and the second direction. The two steering sleeves 625 may drive the two connection sleeves 624 and the two first wheels 20 to turn after rotating.

It should be explained that in the present application, the notch 7321 is ingeniously formed in the support portion 732 to accommodate a steering shaft 723, so that there is a small height difference between an axis of the output shaft of the second driving member 71 and the center position of the arch portion 731. In other words, the overall height of the toy car in the present application is well controlled, that is, the overall height is reduced.

It can be understood that the transmission rod 64 is spaced apart from the support portion 732 in the third direction, and the first driving member 61, the second driving member 71 and the transmission rod 64 are staggered in the second direction, thereby avoiding the situation that the support portion 732, the first driving member 61, the second driving member 71 and the eccentric member 72 are stacked in the third direction due to the fact that the output shaft of the first driving member 61 is coaxial with the transmission rod 64, reducing the height of the toy car 100 in the third direction, and improving the stability of the toy car 100 during traveling.

In some embodiments, the eccentric member 72 may include a driving sleeve 721, a crank 722 and the steering shaft 723. The driving sleeve 721 is coaxially fixed to the output shaft of the second driving member 71. An extension direction of the crank 722 is perpendicular to the first direction. One end of the crank 722 is fixedly connected to the driving sleeve 721, the other end is fixedly connected to the steering shaft 723, and the driving sleeve 721 and the steering shaft 723 are respectively located on two sides of the crank 722 in the first direction. The steering shaft 723 is accommodated in the notch 7321, and the steering shaft 723 may rotate in the notch 7321 and may be in sliding fit with an inner wall of the notch 7321 in the third direction.

In some other embodiments, the steering shaft 723 may also be rotatably connected to the crank 722. When the steering shaft 723 moves in a circumferential direction, the steering shaft 723 may rotate relative to the crank 722.

In the embodiments of the present application, the crank 722 and the steering shaft 723 are horizontally arranged in the first direction. Compared with the situation that the crank 722 and the steering shaft 723 are arranged in a vertical direction in the prior art, this structure may compress the internal space of the toy car, the overall structure is minimized, the space utilization rate is high, the height or thickness of the toy car can be minimized, the structure is high in adaptability and can be adapted to various low-height sports car simulation models with space limitations, for example, the sports car simulation models with the simulation ratio being 1:43, thereby increasing the degree of simulation of the toy car, and improving the playability. At the same time, in the embodiments of the present application, the crank 722 and the steering shaft 723 are arranged on the same plane in parallel in the horizontal direction. Compared with the situation that the crank 722 and the steering shaft 723 are arranged in the vertical direction in the prior art, this structure may also enable the toy car to perform stable turning fine adjustment, thereby achieving accurate turning, and improving the playability.

Figure 11:
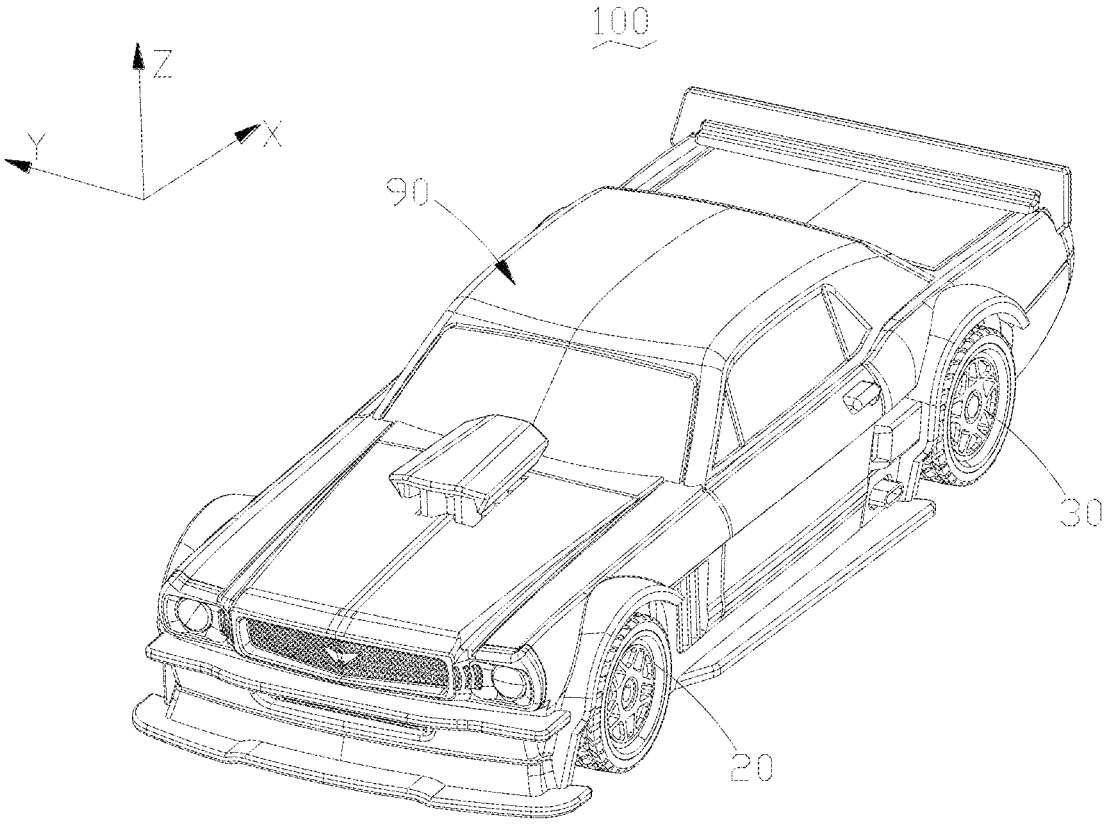
FIG. 11 is a second structural schematic diagram of a toy car in an embodiment of the present application.

Reference is also made to FIG. 10 and FIG. 11, in some embodiments, the toy car 100 may further include a car shell 90. The car shell 90 may cover the chassis 10 and is fixedly connected to the chassis 10. When covering the chassis 10, the car shell 90 may cover the driving mechanism, the steering mechanism 70, the battery 80, the protective shell 40 and the circuit board 50 that are arranged on the chassis 10, thereby shielding the driving mechanism, the steering mechanism 70, the battery 80, the protective shell 40 and the circuit board 50 from one side in the third direction. The car shell 90 may cooperate with the chassis 10, thereby shielding the driving mechanism, the steering mechanism 70, the battery 80, the protective shell 40 and the circuit board 50 from two sides in the third direction.

In the embodiments of the present application, the appearance of the car shell 90 is not specifically limited. FIG. 10 and FIG. 11 respectively show two kinds of appearance of the car shell 90 in the embodiments of the present application.

Figure 12:
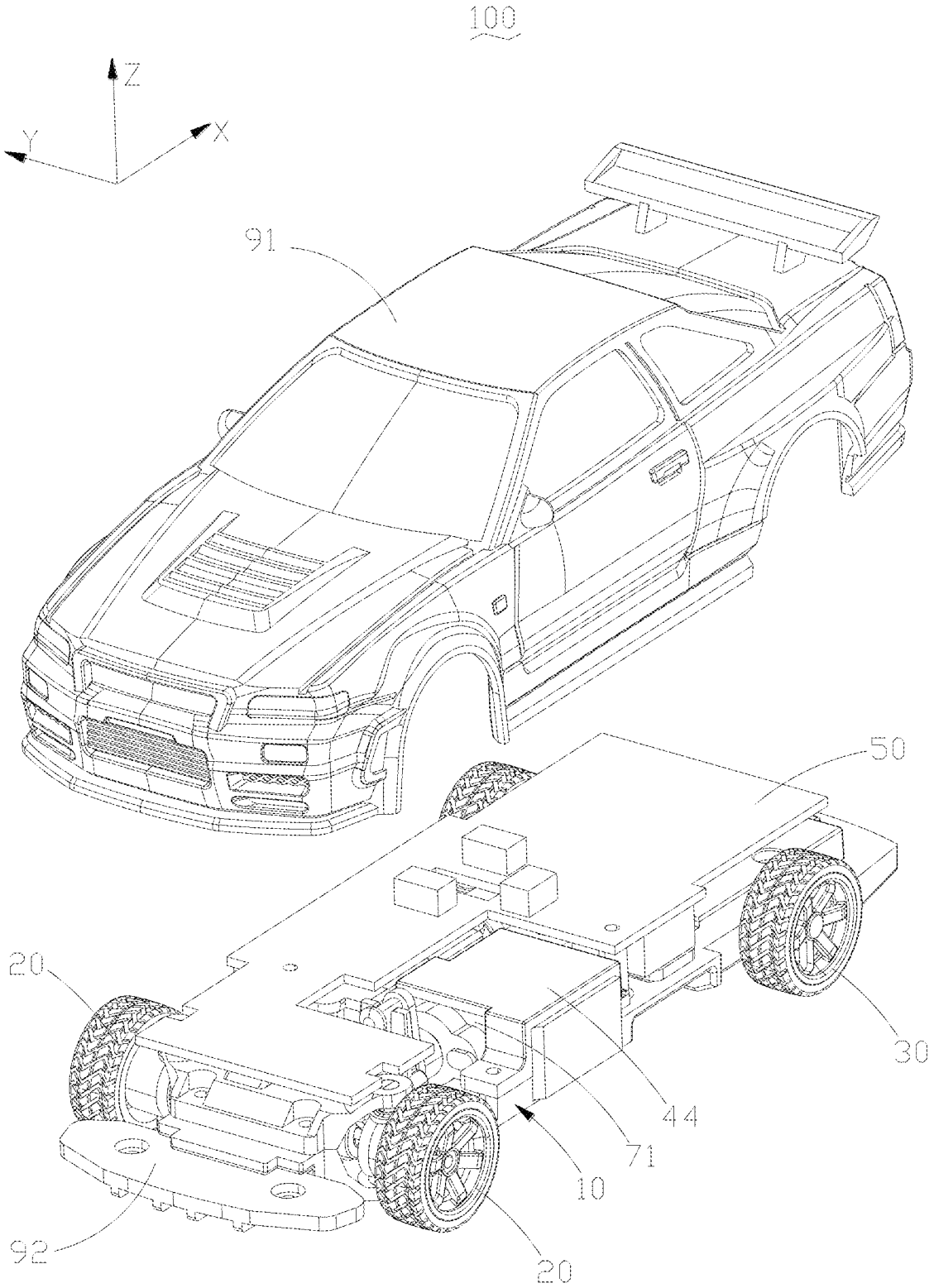
FIG. 12 is a first structural disassembly diagram of the toy car in FIG. 10.
Figure 13:
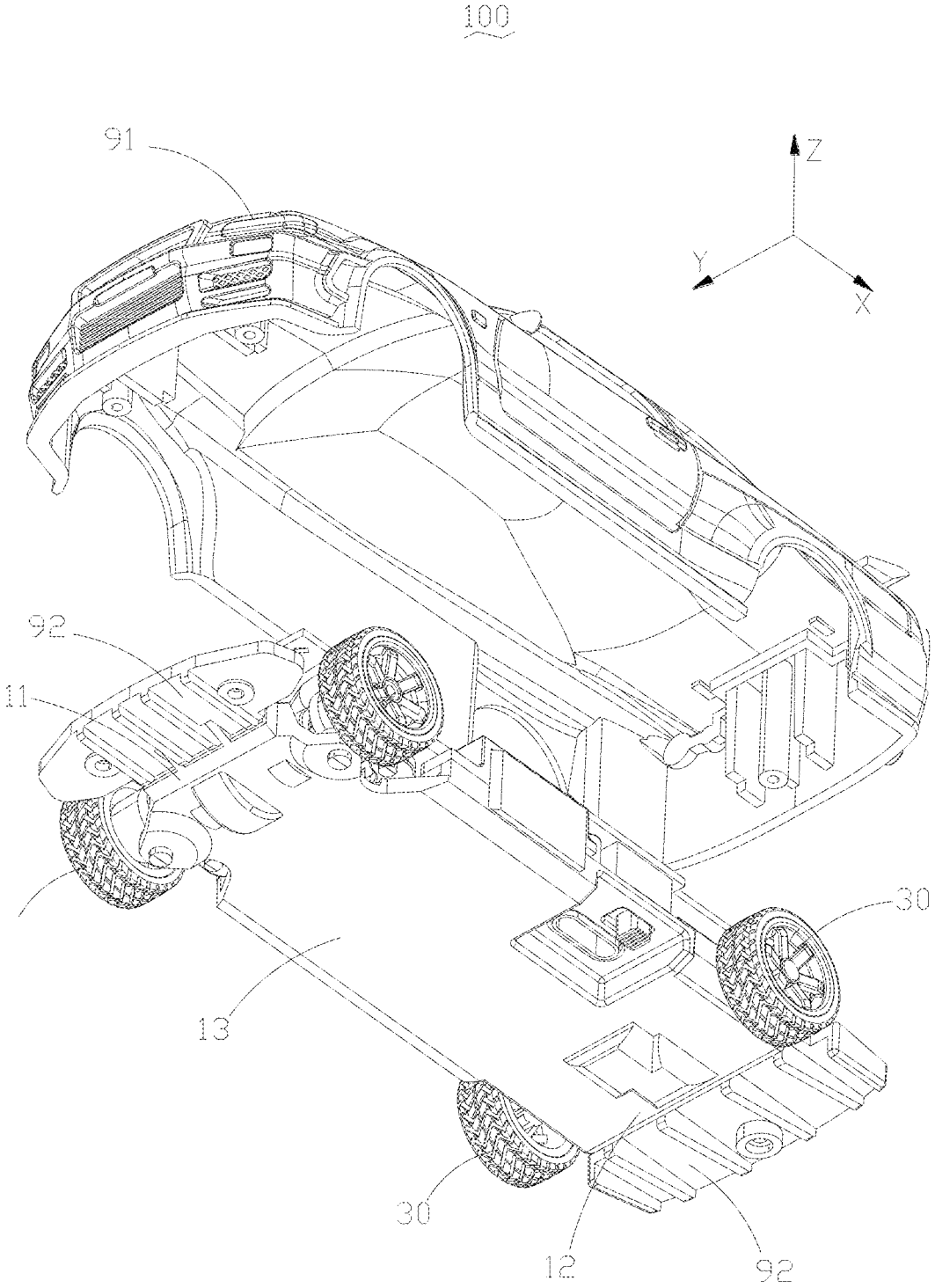
FIG. 13 is a second structural disassembly diagram of the toy car in FIG. 10.

Reference is also made to FIG. 12 and FIG. 13, in some embodiments, the car shell 90 may include a main shell body 91 and split portions 92. The main shell body 91 is located on the side of the circuit board 50 facing away from the chassis 10, and the main shell body 91 shields the driving mechanism, the steering mechanism 70, the battery 80, the protective shell 40 and the circuit board 50 from one side in the third direction.

There may be two split portions 92. One split portion 92 is located on the side of the first end portion 11 facing away from the main shell body 91 in the third direction, and the other split portion 92 is located on the side of the second end portion 12 facing away from the main shell body 91 in the third direction. Each split portion 92 is fixedly connected to the main shell body 91. The main shell body 91 are fitted with the split portions 92 and may be sleeved on the first end portion 11 and the second end portion 12, thereby sleeving the car shell 90 on the chassis 10.

It can be understood that the split portion 92 may be fixedly connected to the main shell body 91 after being fixedly connected to the first end portion 11 or the second end portion 12 in a snap-fit fixing manner; or the split portion 92 may not be fixedly connected to the chassis 10, but is sleeved on the chassis 10 by being fixedly connected to the main shell body 91. This is not limited by the embodiments of the present application.

It can be understood that the main shell body 91 may be fixedly connected to or abut against the chassis 10 when being fixedly connected to the split portions 92. This is not limited by the embodiments of the present application.

In the toy car 100 provided in the embodiments of the present application, the middle body portion 13 may bear the first driving member 61, the second driving member 71 and the battery 80, the first end portion 11 may bear the first transmission assembly 62 and the two first wheels 20, and the second end portion 12 may bear the second transmission assembly 63 and the two second wheels 30. When the first driving member 61 operates, by means of synchronous movement of the transmission rod 64, the first transmission assembly 62 and the second transmission assembly 63, the two first wheels 20 and the two second wheels 30 may be driven to rotate synchronously, thereby achieving four-wheel driving traveling of the toy car 100. When the second driving member 71 operates, the steering frame 73 may be driven to move by means of rotation of the eccentric member 72, thereby driving the two steering sleeves 625 to rotate, achieving the turning of the two first wheels 20, and achieving the turning of the toy car 100.

By arranging the first driving member 61, the second driving member 71 and the battery 80 at the middle body portion 13, the situation that the mass and size of the first end portion 11 are far greater than the mass and size of the second end portion 12 can be reduced, thereby improving the balance of the toy car 100 during traveling, and reducing the rollover probability of the toy car 100 during traveling.

The positioning sleeves 621, the first connection rod 622, the ball-head rods 623, the connection sleeves 624 and the steering sleeves 625 are arranged in the second direction, thereby avoiding the situation that the structures for turning the toy car 100 are stacked on the chassis 10 in the third direction, and reducing the height of the toy car 100. At the same time, the transmission rod 64 is spaced apart from the support portion 732 in the third direction, and the first driving member 61, the second driving member 71 and the transmission rod 64 are staggered in the second direction, thereby avoiding the situation that the support portion 732, the first driving member 61, the second driving member 71 and the eccentric member 72 are stacked in the third direction due to the fact that the output shaft of the first driving member 61 is coaxial with the transmission rod 64, and reducing the height of the toy car 100 in the third direction. Thus, the stability of the toy car 100 during traveling may be improved, and the rollover probability of the toy car 100 during traveling may be reduced.

The above embodiments are only the particular embodiments of the present application, but the scope of protection of the present application is not limited to these embodiments. Any technician familiar with the technical field can easily conceive of various equivalent modifications or substitutions within the scope of technologies of the present application, and these modifications or substitutions should fall within the scope of protection of the present application. Therefore, the scope of protection of the present application should be subject to the scope of protection of the claims.

What is claimed is:

1. A toy car, comprising: a chassis, wherein the chassis comprises a first end portion, a middle body portion and a second end portion which are arranged in a first direction; two first wheels, wherein the two first wheels are arranged at the first end portion and are spaced apart in a second direction, and the first direction is perpendicular to the second direction; two second wheels, wherein the two second wheels are arranged at the second end portion and are spaced apart in the second direction; a first driving member, wherein the first driving member is mounted at the middle body portion, and the first driving member is configured to drive the two first wheels and the two second wheels to rotate; and a second driving member, wherein the second driving member is mounted at the middle body portion, the second driving member and the first driving member are arranged in the first direction and/or the second direction, and the second driving member is configured to drive the two first wheels to turn; an eccentric member, wherein the eccentric member is connected to the second driving member; and a steering frame, wherein the steering frame is movable connected to the first end portion, the steering frame is connected to the two first wheels, and the eccentric member is rotatably connected to the steering frame and is relatively movably connected to the steering frame; and the second driving member is configured to drive the eccentric member to rotate so as to drive the steering frame to move back and forth, thereby achieving turning of the two first wheels; a first transmission assembly, wherein the first transmission assembly is arranged at the first end portion and is connected to the two first wheels, and the steering frame is rotatably connected to the first transmission assembly so as to be connected to the two first wheels; a second transmission assembly, wherein the second transmission assembly is rotatably connected to the second end portion and is connected to the first driving member and the two second wheels; and a transmission rod, wherein the transmission rod is connected to the first transmission assembly and the second transmission assembly; and the first driving member is configured to drive the second transmission assembly to move so as to drive the two second wheels and the transmission rod to rotate, and the transmission rod rotates to drive the first transmission assembly to move so as to drive the two first wheels to rotate; a first positioning platform protrudes from the first end portion in a third direction, the transmission rod is rotatably connected to the first positioning platform, and the third direction is perpendicular to the first direction and the second direction; and the steering frame comprises: an arch portion, wherein the arch portion is arranged around the first positioning platform, the first positioning platform is located in a space defined by the arch portion, and the arch portion is configured to abut against outer walls of two sides of the first positioning platform so as to limit movement of the arch portion; a support portion, wherein the support portion protrudes from the arch portion in the third direction, a notch is formed in the support portion, and the eccentric member is movably connected to the notch in the first direction and is rotatably connected to the notch; and two extension portions, wherein the two extension portions are respectively located on two sides of the arch portion in the second direction and are both connected to the arch portion, and each of the extension portions is rotatably connected to the first transmission assembly.

2. The toy car according to claim 1, wherein the eccentric member comprises: a driving sleeve, wherein the driving sleeve is coaxially fixed to an output shaft of the second driving member; a crank, wherein an extension direction of the crank is perpendicular to the first direction, and one end of the crank is fixedly connected to the driving sleeve; and a steering shaft, wherein the other end of the crank is fixedly connected to the steering shaft, and the driving sleeve and the steering shaft are respectively located on two sides of the crank in the first direction; and the steering shaft is accommodated in the notch, and the steering shaft is capable of rotating in the notch.

3. The toy car according to claim 1, wherein the first transmission assembly comprises: two positioning sleeves, wherein the two positioning sleeves are spaced apart in the second direction and are both rotatably connected to the first end portion; a first connection rod, wherein the first connection rod is located between the two positioning sleeves and is connected to the two positioning sleeves, the transmission rod is connected to the first connection rod, and the transmission rod is configured to rotate to drive the first connection rod and the two positioning sleeves to rotate; two ball-head rods, wherein each of the ball-head rods comprises a rod body and two connection heads, the rod body extends in the second direction, the two connection heads are respectively located at two ends of the rod body in the second direction, and each of the positioning sleeves is sleeved on one connection head of the corresponding ball-head rod and is fixed relative to the connection head; and two connection sleeves, wherein each of the connection sleeves and the corresponding positioning sleeve are spaced apart in the second direction, each of the connection sleeves is sleeved on the other connection head of the corresponding ball-head rod and is fixed relative to the other connection head, and each of the connection sleeves is configured to be connected to the corresponding first wheel.

4. The toy car according to claim 3, wherein the first transmission assembly further comprises:

two steering sleeves, wherein the two steering sleeves are spaced apart in the second direction, each of the steering sleeves is located on the side of the corresponding ball-head rod away from the corresponding positioning sleeve, each of the steering sleeves is sleeved on the corresponding connection sleeve, one end of each of the connection sleeves extends out of the corresponding steering sleeve in a direction away from the corresponding positioning sleeve and is connected to the corresponding first wheel, and the steering sleeves are rotatably connected to the first end portion and are rotatably connected to the steering frame.

5. The toy car according to claim 4, wherein each of the steering sleeves comprises:

a sleeve body, wherein the sleeve body is sleeved on the corresponding connection sleeve;

a first protruding shaft, wherein the first protruding shaft protrudes from a peripheral wall of the sleeve body, the first protruding shaft is rotatably connected to the first end portion, an axial direction of the first protruding shaft coincides with a third direction, and the third direction is perpendicular to the first direction and the second direction; and an extension rod, wherein the extension rod protrudes from the peripheral wall of the sleeve body and is spaced apart from the first protruding shaft, the extension rod is rotatably connected to the steering frame, and an axial direction of a rotation center axis of the extension rod coincides with the third direction.

6. The toy car according to claim 5, further comprising a first end cover, wherein the first end cover is mounted at the first end portion, and the first end cover is configured to shield the first end portion from one side in the third direction; and each of the steering sleeves further comprises a second protruding shaft, the second protruding shaft protrudes from the peripheral wall of the sleeve body, the second protruding shaft is spaced apart from the first protruding shaft and is spaced apart from the extension rod, the second protruding shaft is rotatably connected to the first end cover, and an axial direction of the second protruding shaft coincides with the third direction.

7. The toy car according to claim 4, wherein the first transmission assembly further comprises:

a first driven gear, wherein the first driven gear is connected to the end of the transmission rod facing the first end portion; and a first face gear, wherein the first face gear is coaxially connected to the first connection rod or one of the positioning sleeves, and the first face gear is engaged with the first driven gear.

8. The toy car according to claim 1, wherein a second positioning platform protrudes from the second end portion, and the transmission rod is rotatably connected to the second positioning platform; and the second transmission assembly comprises: a driving gear, wherein the driving gear is connected to the first driving member, and the first driving member is configured to drive the driving gear to rotate; a second driven gear, wherein the second driven gear is connected to the end of the transmission rod facing the second end portion, and the second driven gear is engaged with the driving gear; a third driven gear, wherein the third driven gear is connected to the end of the transmission rod facing the second end portion; a second connection rod, wherein the second connection rod extends in the second direction and is rotatably connected to the second end portion, one end of the second connection rod is connected to one of the second wheels, and the other end of the second connection rod is connected to the other second wheel; and a second face gear, wherein the second face gear is sleeved on the second connection rod and is coaxially connected to the second connection rod, and the second face gear is engaged with the third driven gear.

9. The toy car according to claim 1, further comprising a battery, wherein the battery is mounted at the middle body portion, and the battery is spaced apart from the second driving member in the second direction and is spaced apart from the first driving member in the first direction.

10. The toy car according to claim 1, further comprising:

a protective shell, wherein the protective shell covers the first end portion, the second end portion and/or the middle body portion, the protective shell is configured to shield at least a part of a structure of the first driving member and to shield at least a part of a structure of the second driving member in a third direction, and the third direction is perpendicular to the first direction and the second direction.

11. The toy car according to claim 10, further comprising:

a circuit board, wherein the circuit board is mounted on the protective shell and is located on the side of the protective shell facing away from the chassis.

12. The toy car according to claim 1, further comprising:

a car shell, wherein the car shell is connected to the chassis and is configured to cover the chassis, the first driving member and the second driving member.

13. The toy car according to claim 12, wherein the car shell comprises:

a main shell body, wherein the main shell body is located on one side of the chassis in a third direction, the main shell body is configured to cover the chassis, the first driving member and the second driving member from one side in the third direction, and the third direction is perpendicular to the first direction and the second direction; and a split portion, wherein the split portion is arranged on the side of the chassis facing away from the main shell body, the split portion is connected to the main shell body, and the split portion is configured to be fitted with the main shell body so as to enable the car shell to be sleeved on the chassis.

* * * * *